United States Patent [19]

Sugimura et al.

[11] Patent Number: 4,974,550

[45] Date of Patent: Dec. 4, 1990

[54] ACCUMULATOR WITH SENSOR THROUGH ROLLERS

[75] Inventors: Kazuo Sugimura; Kimihisa Kikkawa, both of Shimizu, Japan

[73] Assignee: Nippon Accumulator Co., Ltd., Japan

[21] Appl. No.: 483,018

[22] Filed: Feb. 21, 1990

[30] Foreign Application Priority Data

Feb. 21, 1989 [JP] Japan ..... 1-40978

[51] Int. Cl.[5] ..... F22B 37/22

[52] U.S. Cl. ..... 122/35; 122/504.2

[58] Field of Search ..... 122/35, 504, 504.2; 137/101.21, 554, 557

[56] References Cited

U.S. PATENT DOCUMENTS 4,027,690 6/1977 Beckmann ..... 122/35 X 4,556,018 12/1985 Agata ..... 122/35

FOREIGN PATENT DOCUMENTS 2145205 3/1985 United Kingdom ..... 122/35

*Primary Examiner*—Edward G. Favors

*Attorney, Agent, or Firm*—Wood, Phillips, Mason, Recktenwald & Vansanten

[57] ABSTRACT

An accumulator with sensor through rollers provided with a rod projecting into a bladder on a cover of a vessel body, a bearing of a float slidable axially on the rod, and also with rollers at a contact portion of the float with the bladder, the bladder sliding the float through the rollers at the bladder contact portion.

7 Claims, 2 Drawing Sheets

ACCUMULATOR WITH SENSOR THROUGH ROLLERS

BACKGROUND OF THE INVENTION

1. Field of the Invention

The present invention relates to an accumulator used for accumulation and buffer of a pressure liquid and, more particularly, to a bladder-type accumulator with sensor.

2. Description of the Prior Art

In a bladder-type accumulartor, if a liquid more than normal in quantity comes into a vessel body according to a fluctuation of liquid pressure, a bladder is capable of being compressed to exceed a threshold. If so, then the bladder is thrust partly into a clearance between the vessel body and a cover to failure. Thus, once the bladder is damaged, a gas leak may arise, and the accumulator is no more functional for accumulation and buffer of a pressure liquid.

Now, therefore, a bladder-type accumulator with sensor has been developed to solve such problem.

The bladder-type accumulator with sensor then comprises providing a rod projecting into the bladder axially on a cover of the vessel body, inserting the middle portion of an elastic bowl-like sensor slidably in the rod, providing a sliding rod on an outer periphery of the rod, linking one end of the sliding rod and an inside of the bowl-like sensor together, and providing a magnet for actuating a switch on the other end.

Then, the bladder transformed according to a change in liquid pressure pushes the elastic bowl-like sensor to slide the sensor and the sliding rod, and when the sliding rod shifts as far as a predetermined position, a switch is turned on to generate a signal.

Then, the following problems are inherent in the prior art bladder-type accumulator with sensor.

(1) Since the elastic bowl-like sensor slides as coming in contact directly with the rod, there arises a sliding friction.

Consequently, the sensor does not slide smoothly, and thus is prevented from transforming essentially or quickly to coordinate with a liquid pressure fluctuation.

(2) The elastic bowl-like sensor slides as coming in face contact with the bladder, therefore a sliding friction also arises here.

Consequently, a contact surface of the bladder and the elastic bowl-like sensor wears to failure, therefore it must be replaced as occasion demands.

That is, as the elastic bowl-like sensor is disposed within the bladder, a life of the bladder is shortened.

Further, when the elastic bowl-like sensor slides, not only a sliding friction against the rod but also a sliding friction against the bladder as mentioned above arises, therefore the sensor becomes hard still further to slide smoothly.

Thus, the pressure liquid becomes hard more and more to come smoothly into the accumulator, and a performance of the accumulator comes to deteriorate.

SUMMARY OF THE INVENTION

In view of the circumstances mentioned above, an object of the invention is to keep the accumulator from deteriorating in performance and also to prevent the bladder from being damaged despite a sliding part of the sensor being provided within the bladder.

The invention comprises providing a rod projecting into a bladder on a cover of a vessel body, providing a bearing of a float slidable axially of the rod, providing rollers on a contact zone of the float with the bladder, thus the bladder sliding the float as rotating the rollers on the contact zone of the float with the bladder when the bladder is pushed on a liquid pressure to transformation.

DETAILED DESCRIPTION OF THE PREFERRED EMBODIMENT

Figure 1:
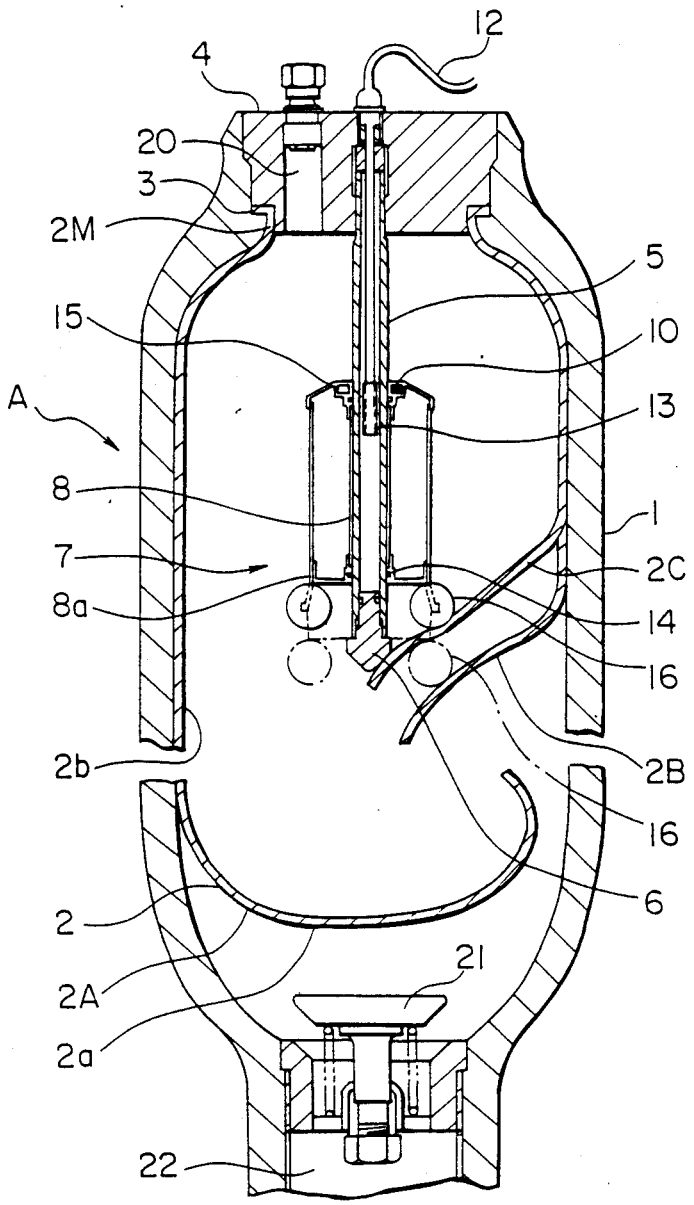
FIG. 1 is an enlarged longitudinal sectional view representing a mode of operation of the invention.
Figure 2:
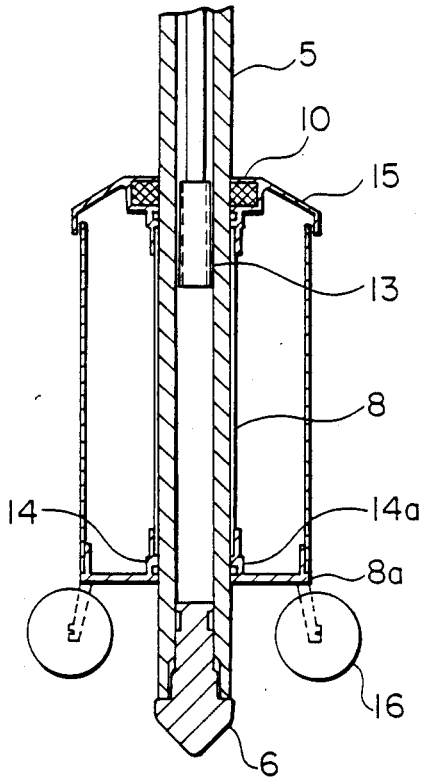
FIG. 2 is an enlarged bottom view.
Figure 3:
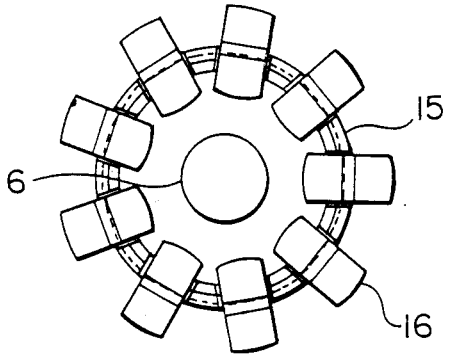
FIG. 3 is a longitudinal sectional view showing an operating state.

A preferred embodiment of the invention will now be described with reference to the accompanying drawings, wherein like reference characters represent like parts and functions in the different views thereof.

A vessel body 1 of an accumulator A is formed of a rigid material such as metal or the like into a shape large in withstanding pressure.

A bladder 2 is inserted within the vessel body 1, a flange portion 3 is held between the vessel body 1 and a cover 4, and an opening portion 2M is blocked up with the cover 4. The bladder 2 is formed of a soft elastic material such as rubber or the like, and a pleat bladder disclosed in Japanese Patent No. 433550, for example, will be used.

The bladder 2 is baggy with a top portion 2*a* as a free end, and a plurality of fold grooves are formed longitudinally on a drum portion 2*b*.

A rob 5 projecting into the bladder 2 is provided at the middle of the cover 4. The rod 5 is a nonmagnetic hollow rod with a stopper 6 provided on its nose portion. A switch 13 is provided within the rod 5, and a magnetic contactless switch actuated, for example, when a magnet sensor 10 comes near thereby is used for the switch. The switch 13 is connected to an external alarm device through a lead wire 12.

A float 8 of a sensor 7 is fitted slidably in the rod 5 through balls 14*a* of a bearing 14, and a cover 15 is provided on the outside thereof. A plurality of rollers 16 are disposed annularly at regular intervals on a contact portion 8*a* of the float 8 with the bladder. The rollers 16 are provided projectingly outside of the cover 15.

Next, an operation of the embodiment will be described.

A gas is forced in from a feed/exhaust port 20 to keep the bladder 2 at a predetermined pressure internally, a motor (not indicated) is then driven, and when a liquid in a tank (not indicated) is forced into a liquid outlet/inlet 22, the liquid pushes a valve body 21 to open and also pushes the bladder 2.

Then, when a liquid pressure is gradually intensified, first the bladder top portion 2*a* ascends, and the bladder 2 holds as indicated by 2A. The drum portion 2*b* of the bladder 2 is tranformed radially to be a chain-lined state 2B thereafter, and comes in contact with the rollers 16 of the float 8 supported on the stopper 6.

Then, the bladder 2B provides an upward force to the float 8 as rotating the rollers 16, therefore the bearing 14 of the float 8 ascends along the rod 5 through the balls 14*a*, and thus the sensor comes to the position 7 in a full line, and the bladder holds as indicated by 2C.

The magnet sensor 10 gradually ascends to come near to the switch 13 according as the bearing 14 slides, therefore the switch 13 is turned on to actuate an alarm device.

Then, when the liquid pressure is gradually weakened, the bladder 2 discharge, as swelling, the liquid in the accumulator A from the liquid outlet/inlet 22.

In this case, the sensor 7 descends as rotating the rollers 16 of the float 8 and the balls 14*a*, and then comes in contact with the stopper 6 to a state in a chain line.

The bladder-type accumulator relating to the invention comprises providing the bearing of the float slidable axially on the rod as described above, providing the rollers at the contact portion of the float with the bladder, therefore when the bladder is transformed according to a fluctuation of the liquid pressure to push the rollers, the rollers push, as rotating, the sensor axially.

As a result, the float slides through the bearing, and when it reaches a predetermined position, the switch is turned on.

Thus, a rolling friction works between the bladder and the rollers, and also between the float and the rod when the float slides.

Since the float slides smoothly consequently, the bladder is quickly transformed correspondingly to a fluctuation of the liquid pressure to slide the float accordingly, therefore a pressure liquid can be accumulated and buffered efficiently unlike the prior art, and hence a performance of the accumulator will never be lowered.

In this connection, it was found that the accumulator of the invention was efficient about ten times as much as the prior art accumulator as the result of having measured the quantity of an oil per hour flowing into the accumulator.

Further, since the bladder comes in contact with the float at the contact portion through the rollers, a rolling friction does not arise between the bladder and the rollers.

Consequently, an amount of wear of the bladder is minimized as compared with the conventional sliding friction, and hence a failure will almost not arise on the bladder. A life of the bladder may be prolonged accordingly.

What is claimed is:

1. An accumulator with sensor through rollers, comprising:

a vessel body provided with a liquid outlet/inlet on one end and a cover on the other end;

a bladder provided within the vessel body and closed with said cover at the opening portion;

a rod provided on the cover and projecting into the bladder;

a bearing of a float provided on the rod and slidable axially thereof;

rollers provided at a contact portion of the float with the bladder and rotated on a push of the bladder.

2. The accumulator with sensor through rollers as defined in claim 1, the rod being a nonmagnetic hollow rod.

3. The accumulator with sensor through rollers as defined in claim 2, wherein a switch is provided inside the nonmagnetic hollow rod.

4. The accumulator with sensor through rollers as defined in claim 3, wherein the switch is actuated by a magnet sensor provided on the float.

5. The accumulator with sensor through rollers as defined in claim 1, wherein the bearing is provided with balls.

6. The accumulator with sensor through rollers as defined in claim 1, wherein the float is provided with a cover.

7. The accumulator with sensor through rollers as defined in claim 1, wherein rollers more than one are provided.

* * * * *